US006499445B2

(12) United States Patent
Han

(10) Patent No.: US 6,499,445 B2
(45) Date of Patent: Dec. 31, 2002

(54) TWO-STROKE ENGINE

(76) Inventor: Xiao-jing Han, P.O. Box 94, Lan Zhou City, Gan Su Province 730000 (CN)

( * ) Notice: Subject to any disclaimer, the term of this patent is extended or adjusted under 35 U.S.C. 154(b) by 0 days.

(21) Appl. No.: 10/074,298

(22) Filed: Feb. 12, 2002

(65) Prior Publication Data

US 2002/0073954 A1 Jun. 20, 2002

Related U.S. Application Data

(63) Continuation of application No. PCT/CN01/00966, filed on Jun. 13, 2001.

(30) Foreign Application Priority Data

Jun. 15, 2000 (CN) ..... 00226540

(51) Int. Cl.[7] ..... F02B 53/00
(52) U.S. Cl. ..... 123/45 R; 123/74 R; 123/197.3
(58) Field of Search ..... 123/45 R, 74 R, 123/74 AE, 197.4, 197.3

(56) References Cited

U.S. PATENT DOCUMENTS

| | | | | |
|---|---|---|---|---|
| 1,290,496 A | * | 1/1919 | Boyd | 123/45 R |
| 1,474,325 A | * | 11/1923 | Kallmeyer | 123/45 R |
| 1,821,685 A | * | 9/1931 | Ames | 123/45 R |
| 5,040,496 A | | 8/1991 | Plohberger et al. | |

FOREIGN PATENT DOCUMENTS

| | | |
|---|---|---|
| CN | 1217421 | 5/1999 |
| DE | 3001152 | 8/1991 |
| FR | 2566459 | 12/1985 |

* cited by examiner

*Primary Examiner*—Noah P. Kamen
(74) *Attorney, Agent, or Firm*—Schnader Harrison Segal & Lewis LLP

(57) ABSTRACT

A two-stroke engine including a cylinder body having an air intake and an air vent, a piston slidably positioned in a portion of the cylinder body and having an admission passage and an air channel located in an upper portion of the piston, a crankshaft rotatably positioned in another portion of the cylinder body and having a cam, a connecting rod connected between the piston and the cam shaft, the connecting rod comprising an upper portion connected to the piston and a lower portion connected to the crankshaft at the cam, the upper and lower portions connected to each other and being rotatable with respect to each other, and a spring actuated tappet slidably locted in slots in the upper and lower portions and biased against the cam on one end of the tappet, another end of the tappet connected to the upper portion such that sliding action of the tappet in response to rotation of the cam causes the upper portion to rotate a selected amount with respect to the lower portion, which causes the piston to rotate with respect to the cylinder body, thereby causing alignment or non-alignment of the admission passageway and the air intake, and alignment or non-alignment of the air channel and air vent at selected cycles of rotation of the crankshaft.

4 Claims, 4 Drawing Sheets

TWO-STROKE ENGINE

RELATED APPLICATIONS

This is a continuation of PCT/CN01/00966, with an international filing date of Jun. 13, 2001, which claims benefit of Chinese Application No. 00226540.0, filed Jun. 15, 2000.

FIELD OF THE INVENTION

This invention relates to an engine with a kind of internal combustion dynamic power, particularly to a two-stroke engine.

BACKGROUND

Two-stroke engines are typically relatively simple in structure, light in weight, stable in operation, easy to maintain and stronger in output power compared with four-stroke internal combustion engines. Two-stroke engines have, therefore, been widely used in medium and small type engines with output power below 500 ML. However, due to the long duration of short circuiting of the gas inhale and exhaust systems, fuel consumption is increased, which leads to higher fuel expense than the four-stroke internal combustion engine. Simultaneously, the luboil involved in the combustion process results in serious environmental pollution. With the promotion of requirements for environmental protection and energy savings, the number of two-stroke internal combustion engines is decreasing seriously—to the verge of being eliminated.

Therefore, it would be advantageous to provide a new design of two-stroke engine which is simple in structure and light in weight, which can save energy and promote fuel efficiency, and which can avoid short-circuiting of air intake and exhaust system, and prevent luboil from being involved in combustion to reduce the pollution to environment.

SUMMARY OF THE INVENTION

This invention relates to a two-stroke engine including a cylinder body having an air intake and an air vent, a piston slidably positioned in a portion of the cylinder body and having an admission passage and an air channel located in an upper portion of the piston, a crankshaft rotatably positioned in another portion of the cylinder body and having a cam shaft, a connecting rod connected between the piston and the cam shaft, the connecting rod including an upper portion connected to the piston and a lower portion connected to the crankshaft at the cam, the upper and lower portions connected to each other and being rotatable with respect to each other, a spring actuated tappet slidably located in slots in the upper and lower portions and biased against the cam on one end of the tappet, another end of the tappet connected to the upper portion such that sliding action of the tappet in response to rotation of the cam causes the upper portion to rotate a selected amount with respect to the lower portion, which causes the piston to rotate with respect to the cylinder body, thereby causing alignment or non-alignment of the admission passageway and the air intake, and alignment or non-alignment of the air channel and air vent at selected cycles of rotation of the crankshaft.

DETAILED DESCRIPTION

Figure 1:
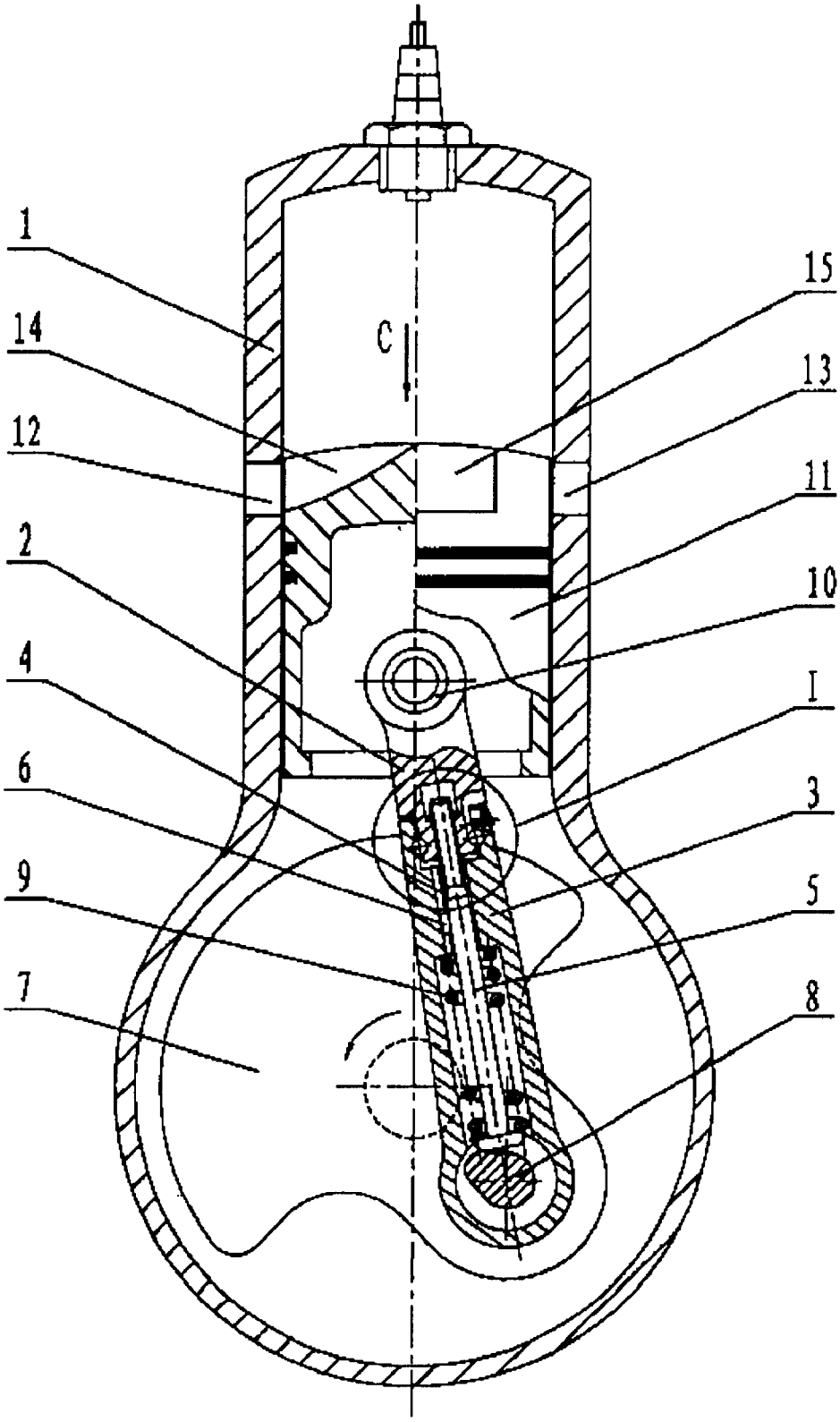
FIG. 1 is a schematic front elevational view, taken partly in section, of an embodiment of the invention.

It will be appreciated that the following description is intended to refer to specific embodiments of the invention selected for illustration in the drawings and is not intended to define or limit the invention, other than in the appended claims.

An embodiment of an engine with two strokes in accordance with aspects of the invention is described below in combination with the drawings and operational procedures therewith in detail as follows.

Figure 2:
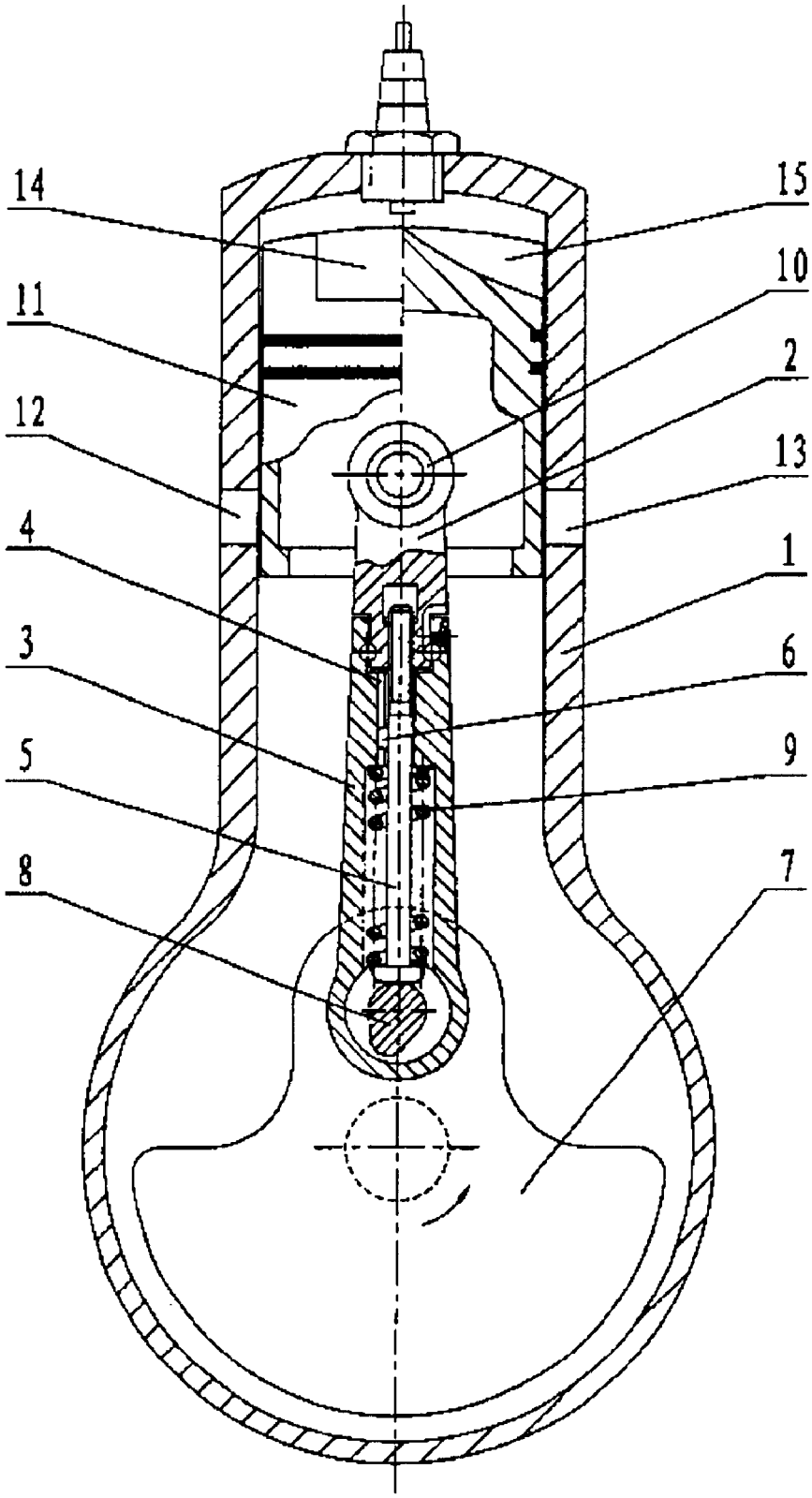
FIG. 2 shows the embodiment of FIG. 1 at a different point of operation with respect to compression and gas openings.
Figure 4:
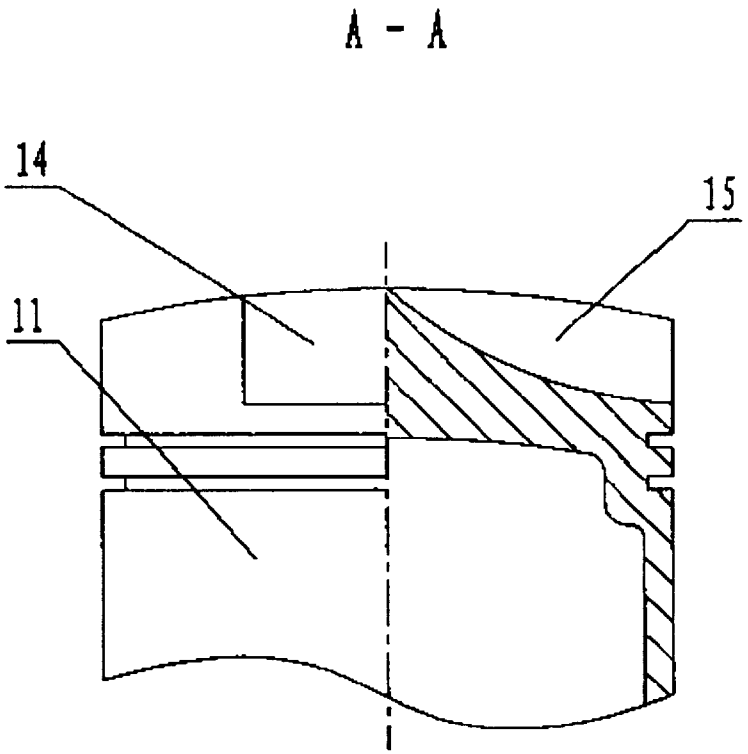
FIG. 4 shows a sectional view of piston of the invention taken along the lines A—A from FIG. 1.
Figure 3:
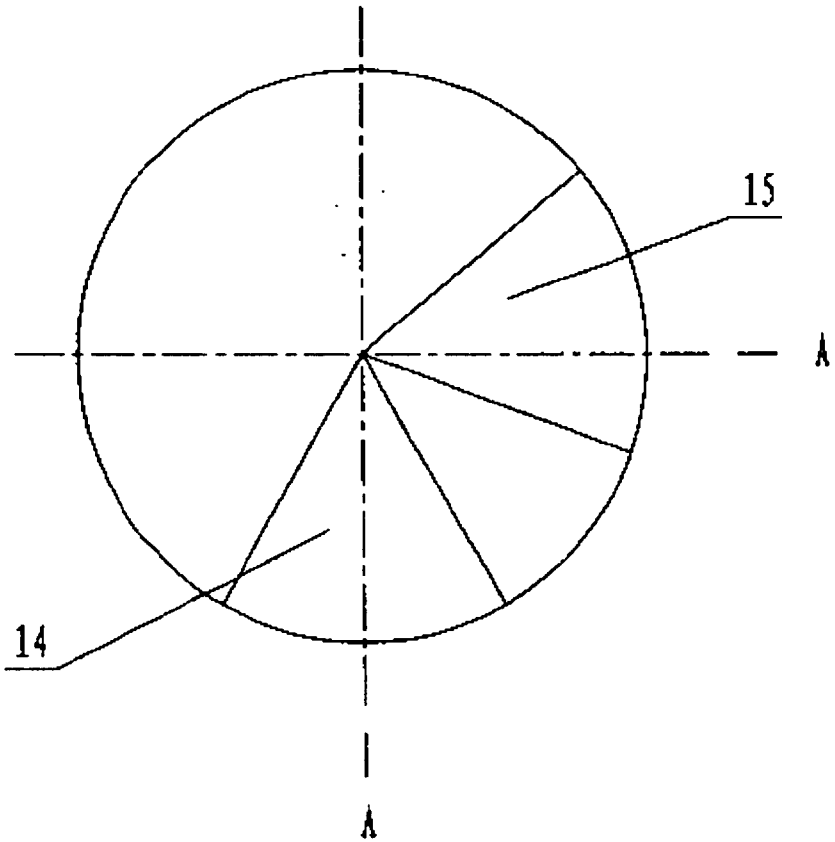
FIG. 3 shows a schematic view of a piston of the invention taken along the arrow "C" from FIG. 1.
Figure 5:
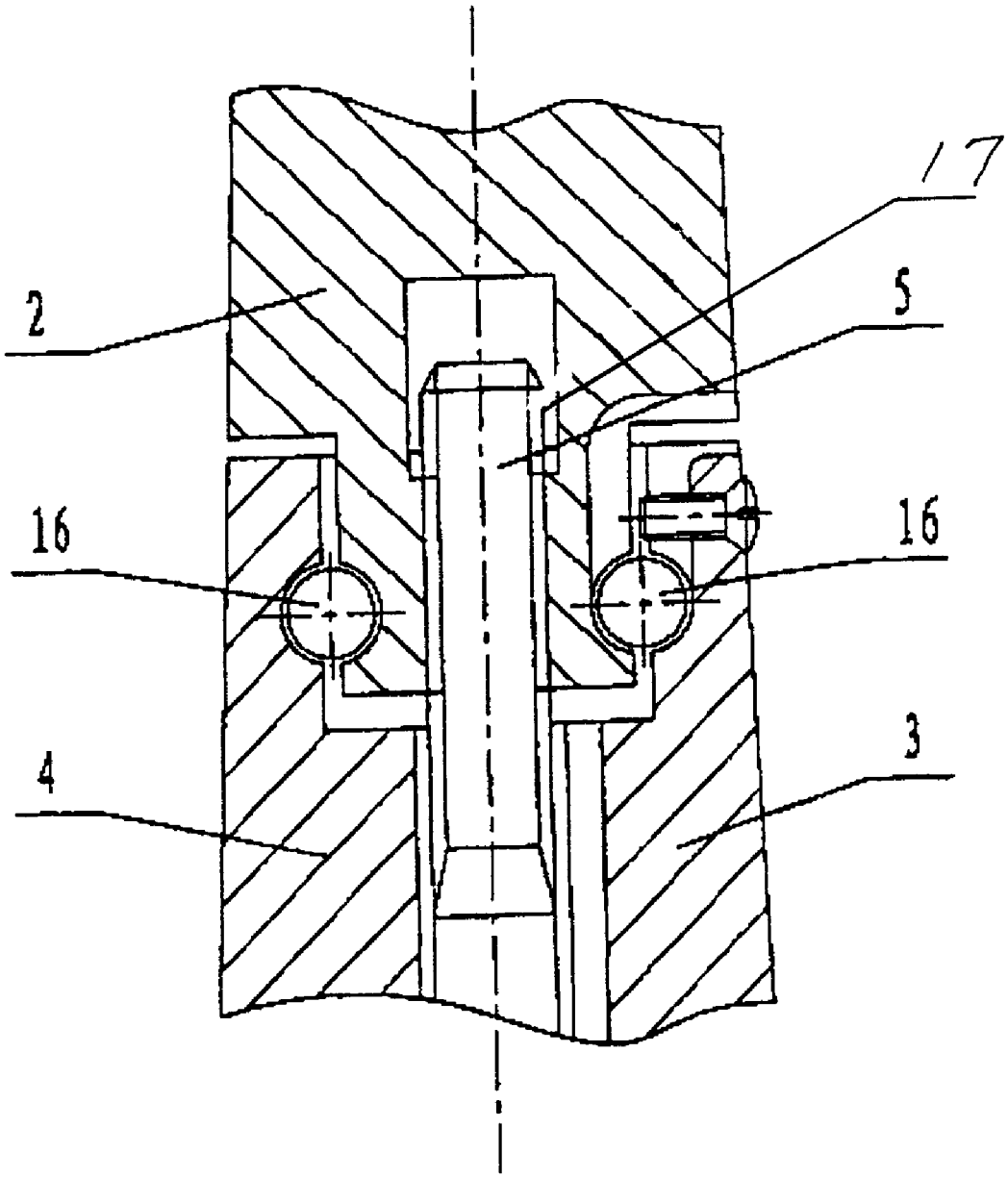
FIG. 5 shows an amplified schematic view, taken partly in section, of an upper and lower section of the connecting rod shown in FIG. 1.

Turning now to the drawings in general and with reference to FIGS. 1 and 2 in particular, a two-stroke engine includes cylinder (1), connecting rod, crankshaft (7) and piston (11). Air intake (12) and air vent (13) are located at the contour position of the lower dead center of cylinder body (1), where the cylinder sidewall is near to piston (11). With reference to FIGS. 3 and 4, admission passage (14) and air channel (15) are installed at the upper part of piston (11). With reference to FIG. 5, through piston pin (10), piston (11) and the upper section of connecting rod (12) are connected by a conventional technique.

The upper section of connecting rod (2) is connected with the lower section of connecting rod (3) through ball (16), and then connected with crankshaft (7). The crankshaft (7) is positioned internally at the lower section of the connecting rod (3), over the crankshaft cam (8) is mounted tappet (5) with reset springs (9) surrounding it. Reset springs (9) are installed at the tappet (5), the top part of which is connected with the lower portion of the upper section of connecting rod (2) through helical gear joint (17). At the tappet (5), convex tappet side (6) is designed, which can slide in the lower recess of the lower section of connecting rod (3). The piston's rotation through two angles or degrees of rotation is driven by the tappet (5). The two rotational angles are formed between air channel (15) and air vent (13), and between admission passage (14) and air intake (12) so that they align to take in air or exhaust/vent exhaust gases as appropriate.

The working principle of the two-stroke engine is as follows:

When crankshaft (7) rotates and drives connecting rod and piston (11) to move downwardly until it approaches the lower dead center position, air channel (15) aligns with air vent (13) and vents exhaust gas out of the cylinder body (1). Due to the mass force produced by quickly escaping burned gas, the inside of cylinder body will be in a suction or intake state, and the crankshaft will continue to rotate. By virtue of the movement action of crankshaft cam (8) during crankshaft rotation, tappet (5) rises and rotates the upper section of connecting rod with helical gear joint (17) which rotates piston (11) a selected angle and opens air intake (12). Then, air vent (13) forms an overlapping angle, through which burning oil injector admits fresh air to sweep away the remaining exhaust gas until air vent (13) closes completely and air intake (12) opens completely, through which fresh air and oil enter cylinder body (1), thus completing the air-input process. The degree of rotation of piston (11) depends on the meshing length of helical gear joint (17), which is located at the upper section of connecting rod (2) and tappet (5). Piston (11), driven by crankshaft (7), continues to move toward the upper dead center; and with the bias action of reset springs (9), tappet (5) drives the upper section of connecting rod (2) to make piston (11) rotate with inversion to a certain angle to restore piston (11) to its initial state. Thus, the engine finishes a working cycle process and continues to move in cycles.

Thus, the two-stroke engine of the invention is simple yet elegant in its construction. It includes a cylinder, connecting rod, crankshaft and piston. Air intake and air vent are designed to align with the piston at the contoured position of the cylinder wall when the connecting rod is at its lower dead center rotational position, where the cylinder's sidewall is near to piston. An admission passageway and air channel are located at the top part of piston. The piston is connected to the crankshaft by the movement of the upper section and the lower section of the connecting rod. The crankshaft is connected to the lower section of the connecting rod over the crankshaft cam which has a tappet with surrounding reset springs connected to it. The top of the tappet is connected with the lower of the upper section of connecting rod through a helical gear joint. Tappet is connected with the lower section of connecting rod through the key-slot slide.

Accordingly, the invention has the following advantages:

1. The air intake and air vent are designed at the contoured position of the lower dead center, where the cylinder's sidewall is near to the piston. The admission passage and air channel are set at the same contour position of the piston. The angle formed by the central lines of the air intake and air vent is larger than that of the piston's admission passage and air channel. Therefore, short circuiting of air intake and the exhaust system can be effectively avoided, energy can be reserved and the utilization efficiency of the fuel can be improved. As the fuel injector in the fuel admission process directly atomizes fuel into the cylinder, the disadvantage of the prior art that the luboil is mixed with the fuel can be avoided. The result is that pollution caused by the exhaust gases is greatly reduced.
2. There is no need for extra parts such as a cam for the air valve and the control valve. Thus, the engine is lighter in mass, lower in height, more flexible in structural design and assembly, more stable in operation and lower in cost.
3. The air intake and air vent on the sidewall of the cylinder are covered within the range of the piston travel. Thus, the lubrication will be maximized without the luboil flowing into the air intake or air vent.

The advantageous structural design of the two-stroke engine is displayed by the fewest hermetic units and shortest gas intake distance. In the working process of the crankshaft driving the piston, air intake and air vent can open and close in accordance with timing. Air intake and air venting will always be in the stroke range of piston sidewall's movement, so it receives an excellent level of lubrication. Thus, luboil will not influx into the air intake and the air vent. The two-stroke engine is widely applicable to the fields of reciprocable piston enternal combustion petrol-ignition engines and diesel oil compressing itnition engines. Therefore, the engine will be highly applicable in such fields as motive power machines in use in cars, outboard engines, miniaturized power tools and the like.

What is claimed is:

1. A two-stroke engine comprising:

a cylinder body having an air intake and an air vent;

a piston slidably positioned in a portion of the cylinder body and having an admission passage and an air channel located in an upper portion of the piston;

a crankshaft rotatably positioned in another portion of the cylinder body and having a cam;

a connecting rod connected between the piston and the cam shaft, the connecting rod comprising an upper portion connected to the piston and a lower portion connected to the crankshaft at the cam, the upper and lower portions connected to each other and being at least partially rotatable with respect to each other; and a spring actuated tappet slidably located in slots in the upper and lower portions and biased against the cam on one end of the tappet, another end of the tappet connected to the upper portion such that sliding action of the tappet in response to rotation of the cam causes the upper portion to rotate a selected amount with respect to the lower portion, which causes the piston to rotate with respect to the cylinder body, thereby causing alignment or non-alignment of the admission passageway and the air intake, and alignment or non-alignment of the air channel and air vent at selected cycles of rotation of the crankshaft.

2. The engine of claim 1, wherein the another end of the tappet has a helical gear joint which engages the upper portion to cause rotation of the piston.

3. The engine of claim 1, wherein rotation of the piston is reciprocating rotation.

4. The engine of claim 1, further comprising a plurality of balls positioned between connecting ends of the upper and lower portions to facilitate rotation of the upper and lower portions with respect to each other.

* * * * *